United States Patent [19]

Stutz et al.

[11] 4,447,955

[45] May 15, 1984

[54] METHOD FOR DETERMINING THE LENGTH OF FILAMENTARY MATERIALS, SUCH AS YARN, WOUND UPON A CROSS-WOUND PACKAGE BY MEANS OF A FRICTION DRIVE AND A GROOVED DRUM

[75] Inventors: Hansruedi Stutz, Dietlikon; Karl Lapp, Zürich, both of Switzerland

[73] Assignee: Loepfe Brothers Limited, Wetzikon, Switzerland

[21] Appl. No.: 445,442

[22] Filed: Nov. 29, 1982

[30] Foreign Application Priority Data

Dec. 4, 1981 [CH] Switzerland ..... 7758/81

[51] Int. Cl.[3] ..... G01B 19/04

[52] U.S. Cl. ..... 33/129; 33/172 F; 242/36; 242/39

[58] Field of Search ..... 33/127–129, 33/132–134, 172 F; 242/36, 39

[56] References Cited

U.S. PATENT DOCUMENTS 4,024,645 5/1977 Giles ..... 33/129

4,330,094 5/1982 Mayer ..... 242/36

4,373,266 2/1983 Stutz ..... 33/129

*Primary Examiner*—Harry N. Haroian

*Attorney, Agent, or Firm*—Werner W. Kleeman

[57] ABSTRACT

During the measurement of the length of filamentary materials, for instance a yarn, which is wound into a cross-wound package which is driven by a grooved drum, appreciable errors arise because there is not taken into account slippage. Therefore, with the present method during the winding operation the slip, which is governed by the relationship of the circumferential velocities of the grooved drum and the cross-wound package, is continuously measured in successive time intervals, and there is undertaken a correction of the yarn length determined without taking into account the slip. Thus, sensors continuously measure the rotational speeds of the cross-wound package and the grooved drum, and an angle measuring device determines the diameter of the cross-wound package, these measuring results then being inputted to an evaluation circuit. In the evaluation circuit there is computed the slip and such is incorporated into the length measurement.

11 Claims, 9 Drawing Figures

METHOD FOR DETERMINING THE LENGTH OF FILAMENTARY MATERIALS, SUCH AS YARN, WOUND UPON A CROSS-WOUND PACKAGE BY MEANS OF A FRICTION DRIVE AND A GROOVED DRUM

BACKGROUND OF THE INVENTION

The present invention relates to a new and improved method for the determination of the length of endless filamentary materials, herein referred to broadly as yarn, which is wound upon a cross-wound package at a winding apparatus or winder containing a friction drive and a grooved drum.

There are already known to the art, for instance, different methods and apparatuses for the continuous measurement of the length of a yarn during the winding thereof onto a rotating core or bobbin. Generally, there are usually formed so-called cross-wound packages, wherein the infed yarn is moved back-and-forth in axial direction of the cross-wound package by means of a yarn or thread guide or a grooved drum. With most of the modern winding machines the cross-wound package is driven by the grooved drum due to frictional contact. Significant in this regard are Swiss Patent No. 568,233 and German Patent No. 2,351,463. The length measurement is predicated upon the continuously measured number of revolutions and the diameter or circumference, as the case may be, of the grooved drum. Further techniques for measuring the length of a travelling endless yarn have been disclosed in British Patent No. 1,480,398.

At the conventional high rotational speeds of the driving grooved drum there is unavoidable an appreciable slip, in other words the trailing of the cross-wound package in relation to the grooved drum. As measurements of the assignee of this application have demonstrated, this slip is not constant during the winding operation. Therefore, it is not possible to obtain an exact correction factor for the entire winding operation by simply carrying out an initial test run as contemplated by German Patent No. 2,216,960, during which time there is measured the yarn length which has been wound-up during one revolution of the grooved drum. Also, heretofore there has not been given any definition of the slip and also there has not been devised any method for the continuous measurement thereof during the winding operation, and probably its significance in this regard has also not been fully appreciated.

In U.S. Pat. No. 4,024,645 there is disclosed a method for continuously determining the length of a wound package at a winding machine having a positively separated drive of the cross-wound package and a thread guide which causes a changing movement of the wound-up yarn. For this purpose there are continuously measured and evaluated the number of revolutions of the cross-wound package and its diameter or circumference. Since with the described winding machine there is not present any slip between the cross-wound package and the thread guide it is also unnecessary to undertake any slip correction at the length measurement.

It might be conceivable to employ the method known from the aforementioned U.S. Pat. No. 4,024,645 also at a winding machine having a friction drive of the cross-wound package by means of the grooved drum, in order to eliminate the effect of slip upon the length measurement. While this would result in an increased accuracy, nonetheless the full effect of the slip would not be taken into account. This will be considered in greater detail hereinafter in conjunctibn with the description of the exemplary embodiments.

SUMMARY OF THE INVENTION

The invention therefore is predicated upon the following problem which heretofore has not found any completely satisfactory solution.

For certain fields of application or endeavor in the textile industry, for instance during the preparation for weaving, there are required for each warping frame a larger number of bobbins, each of which must be provided with packages of as constant yarn length as possible. Unequal yarn lengths result in a high loss in yarn, and accordingly, increased fabrication costs. If, for instance, the package length at the hundreds of bobbins of the warping frame differ by only one percent between the longest and shortest package, then for each 100,000 meters of wound-off yarn length there already occurs a yarn loss which amounts up to 1,000 meters per package.

Therefore, with the foregoing in mind it is a primary object of the present invention to provide a new and improved method for accurately determining the length of a yarn wound upon a cross-wound package by means of a friction drive and a grooved drum.

Still a further significant object of the present invention is directed to a new and improved construction of apparatus for accurately determining the length of a yarn wound upon a cross-wound package by means of a friction drive utilizing a grooved drum while effectively taking into account any occurring slippage.

Yet a further important object of the present invention is to provide an improved method for the length determination of yarn or like filamentary materials, so that, during the frictional drive of the cross-wound package it is possible to produce packages of only very slight differences of, for instance, less than approximately 0.5% of the yarn length.

Now in order to implement these and still further objects of the invention, which will become more readily apparent as the description proceeds, the method aspects of the present development are manifested by the features that, during the winding operation there is continuously measured in successive intervals the slip which is governed by the relationship or ratio of the circumferential velocities of the grooved drum and the cross-wound package, and with the aid of the measured magnitude of the slip there is undertaken a correction of the yarn length determined during the momentary successive intervals without taking into account the slip.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
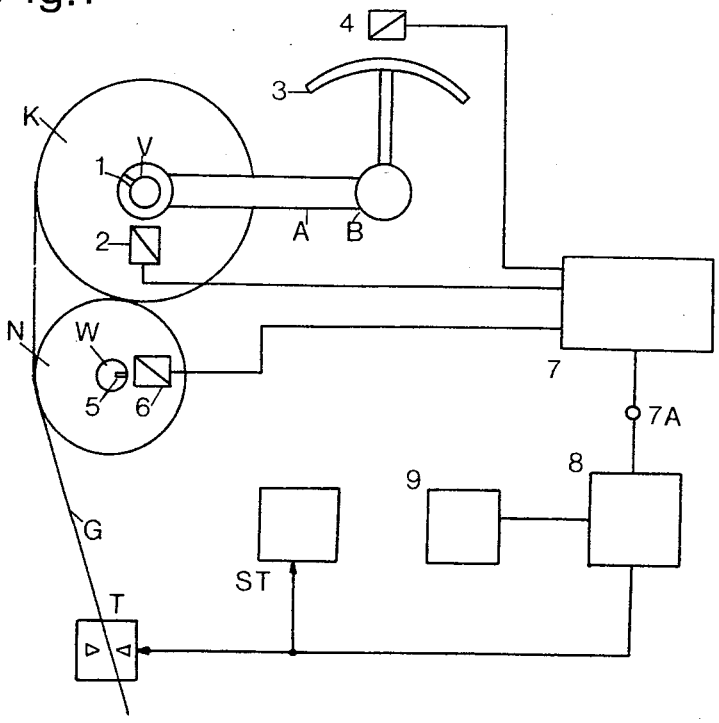
FIG. 1 is a schematic illustration of a winding location or station and the therewith connected length measuring apparatus.

Describing now the drawings, FIG. 1 schematically illustrates an arrangement of apparatus for the measuring of the length of a yarn or the like at an automatic winding machine for winding cross-wound packages, and further illustrates the parts of a winding station or location needed for such purpose. A cross-wound package K, which is seated upon a rotatable shaft V, is in frictional contact at its circumference with a grooved drum N which is mounted upon a shaft W and is driven by a suitable drive motor. The shaft V of the cross-wound package K is rotatably mounted at the free end of a pivotable arm member A which is attached to a shaft B which is pivotable in relation to the frame of the winding machine. The yarn or other filamentary material, guided by the grooved drum N to the cross-wound package K, has been generally designated by reference character G. Furthermore, constituting part of the winding location or station of the winding machine or winder is a separation or cutting device T for the yarn K and a stop motion device ST by means of which the winding station or location can be shutdown.

At the shafts V and W there are mounted a respective magnet 1 and 5 which coact with a machine or frame-fixed induction coil 2 and 6, respectively, so that during each revolution of the shafts V and W there is generated a counting pulse. The induction coil 2 has been designated as a k-sensor, the induction coil 6 as a n-sensor.

In order to determine the angular position of the pivotable or pivotal arm member A, and thus, the diameter D of the cross-wound package K, there is mounted at the pivot shaft B a scale 3 or equivalent structure which is concentric therewith, the position of which scale 3 can be read by a position sensor 4, also referred to as a D-sensor. Equipment of such type containing optoelectrical reading capability are well-known, and specific embodiments thereof have been disclosed in the commonly assigned, copending U.S. Pat. application Ser. No. 06/313,208, filed Oct. 20, 1981, now U.S. Pat. No. 4,373,266 and entitled "Equipment for Continuously Measuring the Length of an Endless Material Being Wound-up into a Circular Package".

The signals delivered by the sensors or feelers 2, 4 and 6 are inputted to an evaluation circuit 7 and processed by such evaluation circuit, as the same will be explained in greater detail hereinafter in conjunction with the following FIGS. 2 to 8.

At the output terminal 7A of the evaluation circuit 7 there is connected the one input of a comparator 8, the second input of which is connected with a reference or set value transmitter 9. The comparator 8 and the set value transmitter 9 serve to stop the winding station or location by means of the stop mechanism ST upon reaching a certain yarn length which has been wound upon the cross-wound package K and to cut the yarn G by means of the cutter device T, as such is well-known in this technology from the previously referred to patents.

The development views depicted in FIGS. 2, 3 and 4 of the grooved drum N and the cross-wound package K serve for explaining the mathematically computed foundation of the measuring technique which will be described hereinafter in detail in conjunction with FIG. 5. To that end there are required the following fixed data of the winding location or station and the following parameters which are to be continuously measured during the winding or spooling operation:

Data of the winding machine:

b=width of the grooved drum and the cross-wound package;

p=number of strokes at the grooved drum;

d=diameter of the grooved drum; and $\alpha$=groove angle.

Measuring parameters:

D=diameter of the cross-wound package;

k=rotational speed of the cross-wound package; and n=rotational speed of the grooved drum.

The slip is defined as the ratio of the circumferential speeds or velocities of the grooved drum N and the cross-wound package K and can be expressed as follows:

$$S=n.d/k.D \quad (1)$$

wherein, reference characters n and k designate the number of revolutions of the grooved drum and the cross-wound package, respectively, within a certain time interval or cycle, which can encompass for instance 1,000 revolutions n or k.

With the first exemplary embodiment of the length measurement as described hereinafter, such is derivable from the determination of the diameter D of the cross-wound package K. In the description to follow it will be demonstrated how the slip S is incorporated into the length measurement.

Figure 2:
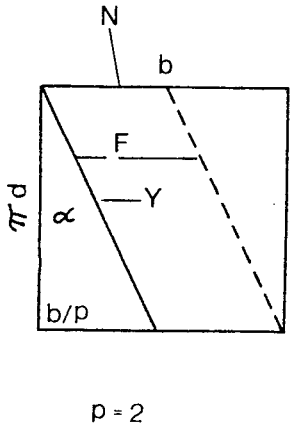
FIG. 2 is a development of the grooved drum used at the winding location or station of the arrangement of FIG. 1 and containing a guide groove.

According to the showing of FIG. 2, the guide groove F, drawn as an inclined line, wraps twice about the grooved drum N, in other words p=2. From FIG. 2 there will be recognized that there is valid for the magnitude of the constant groove angle the following relationship:

$$tg\alpha=b/p\pi d. \quad (2)$$

Figure 3:
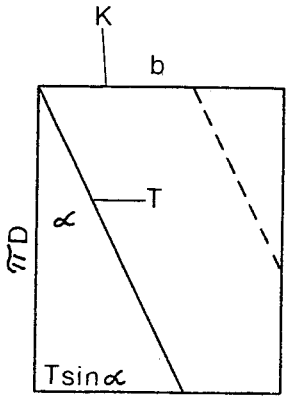
FIG. 3 is a development of a substantially cylindrical cross-wound package containing a yarn or thread winding which has been wound without slip.

FIG. 3 illustrates the length T of an individual yarn or thread winding at the cross-wound package K when there does not exist any slip. In this case the groove angle $\alpha$ again appears without change as the angle between a circumferential line of the length $\pi$D and the yarn or thread winding. The lateral displacement of the yarn or thread during one revolution amounts to T.sin $\alpha$.

Figure 4:
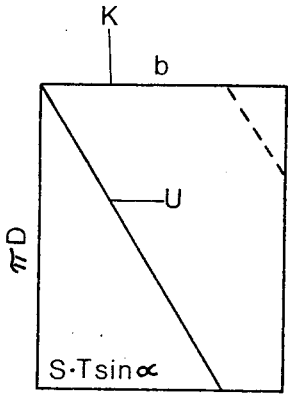
FIG. 4 is a development of the cross-wound package containing a yarn or thread winding which has been wound with slip.

FIG. 4 illustrates the length U of a single yarn or thread winding at the cross-wound package K with slip present. The circumference of the cross-wound package K, in this case, possesses a velocity which is reduced by the ratio 1/S in relation to the circumference of the grooved drum N. Thus, for a complete revolution the cross-wound package K therefore needs S-times more time than in the situation illustrated in FIG. 3, and accordingly, the lateral displacement of the thread is equal to S.T.sin $\alpha$.

From FIG. 3 there will be recognized the following relationship:

$$T=\pi D/\cos\alpha \quad (3)$$

and from FIGS. 3 and 4 there is derivable by basic computations the relationship:

$$U=\pi D\sqrt{1+S^2tg^2\alpha} \quad (4)$$

for the length of a single winding. The equation (4) furnishes the foundation for the measurement of the total length of the wound-yarn or the like. To this end there is required a continuous determination of the variable magnitudes or parameters D and S, whereas according to the equation (2) tg$\alpha$ is a constant magnitude.

If in equation (4) the square root term is replaced by the following correction factor f:

$$f=\sqrt{1+S^2tg^2\alpha} \quad (5)$$

then the above equation (4) can be rewritten in the following simple manner as:

$$U=f.\pi D \quad (6)$$

wherein, $\pi$D constitutes the circumference of the cross-wound package K; by means of the factor f there is determined the influence of both stroke of the grooved drum N and also the slip S upon the length measurement.

Figure 5:
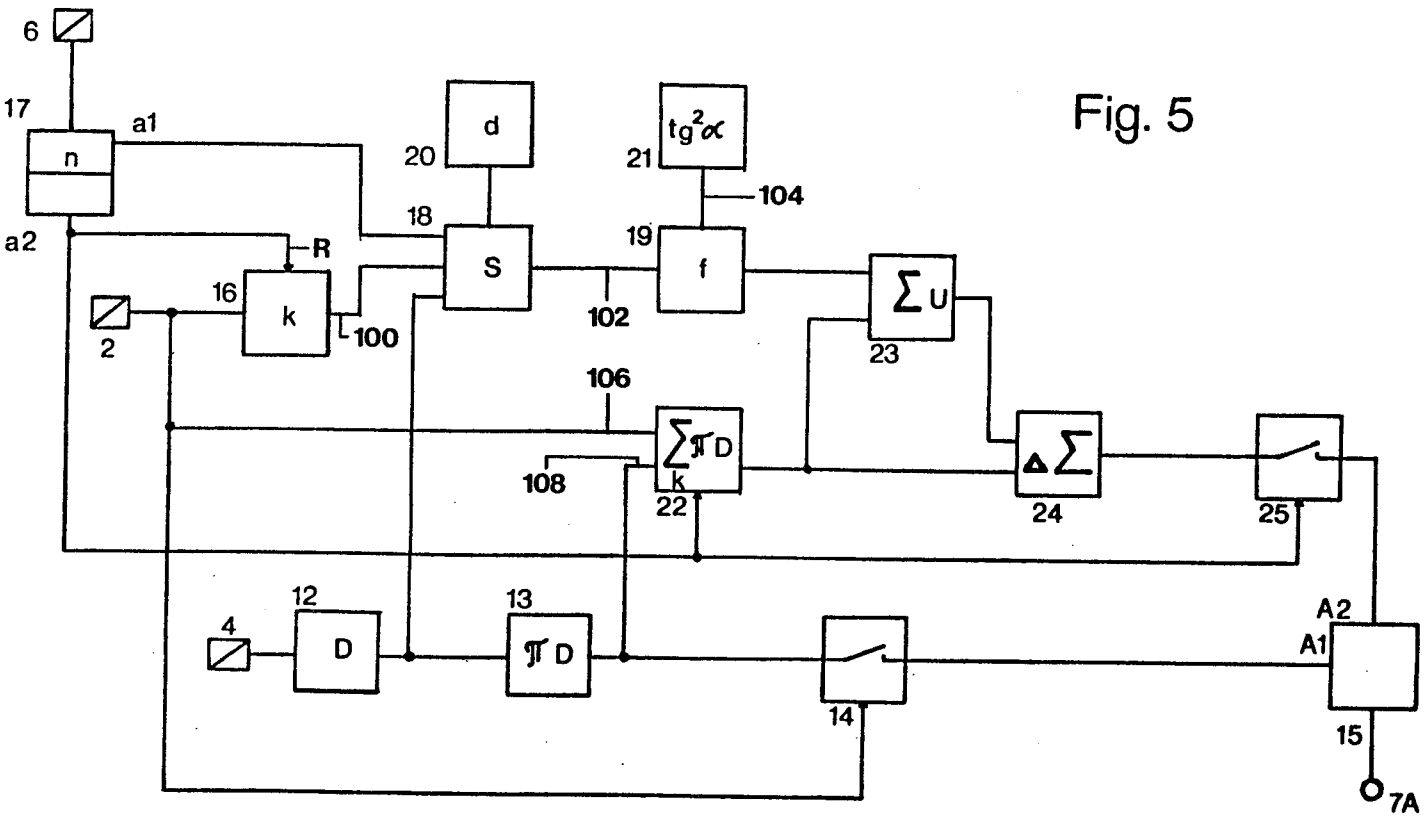
FIG. 5 is a block circuit diagram of a first exemplary embodiment of the length measuring apparatus depicted in FIG. 1.

Turning now to FIG. 5, there will be explained with reference thereto the processing of the signals in the evaluation circuit 7 and which are delivered by the sensors or feelers 2, 4 and 6. This evaluation circuit 7 encompasses two channels. The first channel comprises the switching circuits 12, 13 and 14 which are connected in series between the D-sensor 4 and a length storage 15 which possesses two inputs A1 and A2. Within this channel the D-measuring circuit 12 forms diameter signals representing the magnitude or parameter D, which are converted in the $\pi$-multiplier 13 into the circumference signals of the magnitude $\pi$D. A first electronic switch 14 is closed by each of the k-pulses generated by the k-sensor 2, so that the circumference signal arrives at the input A1 of the length storage 15 and is stored therein. The successive circumference signals are added in this length storage 15.

The second channel serves for generating length-correction signals which are periodically formed and are inputted to the second input A2 of the length storage 15. This second channel encompasses a k-counter 16, a n-counter 17, a slip measuring circuit 18, a f-measuring circuit 19, a summation device or adder 22, a multiplier 23, a subtractor 24, and a second electronic switch 25. Additionally, there are provided for inputting the constant values d and $\alpha$ or tg$^2\alpha$ a d-transmitter and a groove angle transmitter 21, respectively.

The k-counter 16 is connected to the k-sensor 2 and has a reset input R which is connected with the output a2 of the n-counter 17.

The n-counter 17 connected with the n-sensor 6 is constructed as a ring counter and has two outputs a1 and a2: the first output a1 delivers in each case the number n of revolutions of the grooved drum N which are counted within one cycle; one cycle encompasses for instance 1,000 revolutions. At the end of each cycle there is reset the n-counter 17 and such simultaneously delivers a cycle pulse of the output a2.

There is delivered to the slip measuring circuit 18, within each cycle which encompasses n=1,000 revolutions of the grooved drum N, the output signals from the output a1 of the n-counter 17 and those appearing at the output 100 of the k-counter 16, as well as the diameter signals d and D from the d-transmitter 20 and the D-measuring circuit 12, respectively. In the slip measuring circuit 18 there is computed therefrom the value of the slip according to the equation (1) within one cycle and such is inputted to the input 102 of the f-measuring circuit 19, the second input 104 of which is connected with the groove angle transmitter 21. The factor f is computed in the f-measuring circuit 19 in accordance with the equation (5). Parallel thereto there is formed in the summation device 22, both of whose signal inputs 106 and 108 are connected with the k-sensor 2 and the $\pi$-multiplier 13, respectively, the sum of the length of the circumference of the cross-wound package K which has run-off in one cycle, briefly referred to as the circumferential sum. At the end of each one of the cycles the output signal of the summation device 22 represents the circumferential sum which is formed during the cycle; by means of the clock or cycle pulse emanating from the output a2 of the n-counter 17 there is reset the summation device 22.

The circumferential sum is multiplied in the multiplier 23 by the value f from the f-measuring circuit 19, so that there is realized the sum of the length U, see FIG. 4, of the windings which have been wound upon the cross-wound package K. In the subtracting device or subtractor 24 there is subtracted from such length sum the circumferential sum of the summation device 22. Consequently, there is obtained the additional length governed by the groove angle and the slip, which is then cyclically added to the continuously stored circumferential sum and which is determined by the first channel. This is accomplished by means of the electronic switch 25 which is briefly closed at the end of each cycle by a clock or cycle signal, so that the output signal of the subtacting device 24 is inputted into the storage 15 and at that location is added to the circumferential sum. There is thus obtained at the end of each cycle in the length storage 15 the total length of the yarn wound up to that point in time upon the cross-wound package K and which is determined by taking into account the groove angle and the slip.

As an alternative to the circuit arrangement depicted in FIG. 5 such can be modified in such a manner that, instead of the circumference $\pi$.D in the first channel, there is formed the winding length $\pi$D/cos $\alpha$ and such is continuously stored by means of the input A1 in the length storage 15 in accordance with the following equation which is equivalent to the equation (4):

$$U=(\pi D/\cos\alpha)\sqrt{1+(S^2-1)\sin^2\alpha} \quad (7)$$

In this case there is valid for the factor f:

$$f = \sqrt{1 + (S^2 - 1)\sin^2\alpha} \quad (8)$$

The switching circuits 19 and 21 are to be designed in accordance with this equation; instead of inputting the value $tg^2\alpha$ into the groove angle transmitter 21 there is to be inputted the value $\sin^2\alpha$.

FIGS. 6, 7, 8 and 9 explain a different manner of length measurement while taking into account the slip. Firstly, there is proceeded from the yarn or thread length which is applied during one revolution of the grooved drum N upon the cross-wound package K, and secondly, there is determined the slip from each respective revolution of the grooved drum N and the cross-wound package K.

Figure 6:
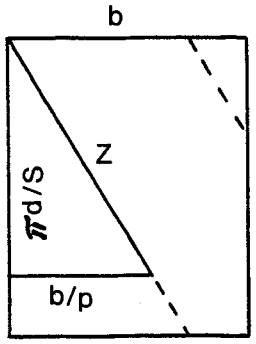
FIG. 6 is a development of the cross-wound package with a portion of a yarn or thread winding which has been wound or laid with slip during one revolution of the grooved drum.

In FIG. 2 the length of a single winding of the groove F of the grooved drum N has been designated by reference character Y. This reference character Y simultaneously designates the yarn length which is applied to the cross-wound package K without the presence of slip. FIG. 6 shows a development of the cross-wound package K while taking into account a slip S. Hence, a point located at the circumference of the cross-wound package K moves through the path $\pi d/S$ during one revolution of the grooved drum N, whereas the stroke has the unaltered value b/p. The thread length which is applied to the cross-wound package K is here desiqnated by reference character Z.

From FIG. 2 there follows the followinq relationship:

$$Y = \pi d/\cos\alpha \quad (9)$$

and from FIG. 6 there follows the following relationship:

$$Z^2 = (b/p)^2 + (\pi d/S)^2. \quad (10)$$

From these equations (9) and (10) there can be derived the following equation:

$$Z = \pi d\sqrt{1/S^2 + tg^2\alpha} \quad (11)$$

analogous to the equation (4), wherein, however, the factor $$g\sqrt{1/S^2 + tg^2\alpha} \quad (12)$$

appears in place of the factor f.

It is readily possible to perform the method described in conjunction with FIG. 5 based upon the equation (4) in accordance with the equation (11); however, this will not be here explained in any further great detail since it merely requires only a very few modifications in relation to the circuit design of FIG. 5.

What is however important is the other type of determination of the slip according to the following equation:

$$S = t_k d/t_n D \quad (13)$$

which corresponds to the equation (1), however, instead of the rotational speeds n and k contains the times or durations $t_n$ and $t_k$ for in each case one revolution of the grooved drum N and the cross-wound package K, respectively. However, it is also possible to measure the times or durations of a fewer number of successive revolutions, for instance $3t_k$ and $3t_n$ and to determine therefrom the value of the slip.

There is thus realized a simplified measuring method in that the slip S can be practically instantaneously determined and is available; it is thus not necessary to evaluate the slip during a longer cycle of, for instance, 1,000 revolutions of the grooved drum.

Figure 7:
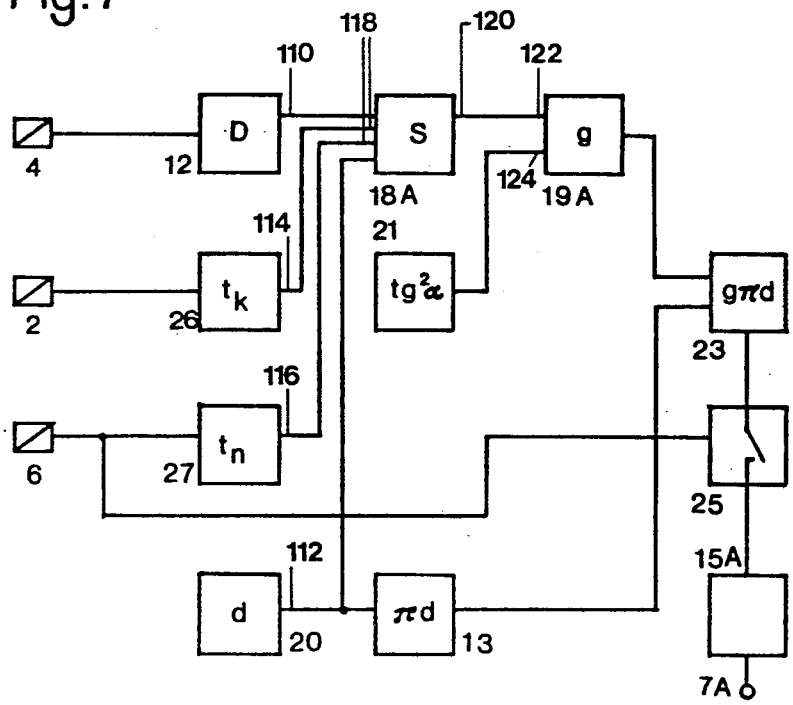
FIG. 7 is a block circuit diagram of a second exemplary embodiment of the length measuring apparatus depicted in FIG. 1.

FIG. 7 illustrates an evaluation circuit which has been designed for this method. At the k-sensor 2 there is connected a K-time measuring circuit 26, and at the n-sensor 6 there is connected a N-time measuring circuit 27. Just as was the case for the arrangement of FIG. 5, here also there is connected with the D-sensor 4 the D-measuring circuit 12, and furthermore, there is provided a d-transmitter 20. The outputs 110, 112, 114 and 116 of the aforementioned circuits 12, 20, 26 and 27, respectively, are connected to the four separate inputs 118 of the slip measuring circuit 18A, the output 120 of which is connected with one input 122 of both inputs 122, 124 of the g-measuring circuit 19A. The other input 124 of the g-measuring circuit 19A is connected with the groove angle transmitter 21.

In the slip measuring circuit 18A there is continuously determined the slip S according to the equation (13) and in the g-measuring circuit 19A there is determined the factor g according to the equation (12).

The output 112 of the d-transmitter 20 is connected with the $\pi$-multiplier 13. In the multiplier 23 there are multiplied the output signals of the $\pi$-multiplier 13 and the g-measuring circuit 19A, and there is continuously computed the value of a yarn length Z according to the equation (11). The electronic switch 25 which is connected with the multiplier 23 is briefly closed by each n-pulse, that is to say, during each revolution of the grooved drum N. Consequently, the output signal of the multiplier 23 arrives at the storage 15A and at that location is stored and continuously added to the total length of the wound-up yarn or the like.

Figure 9:
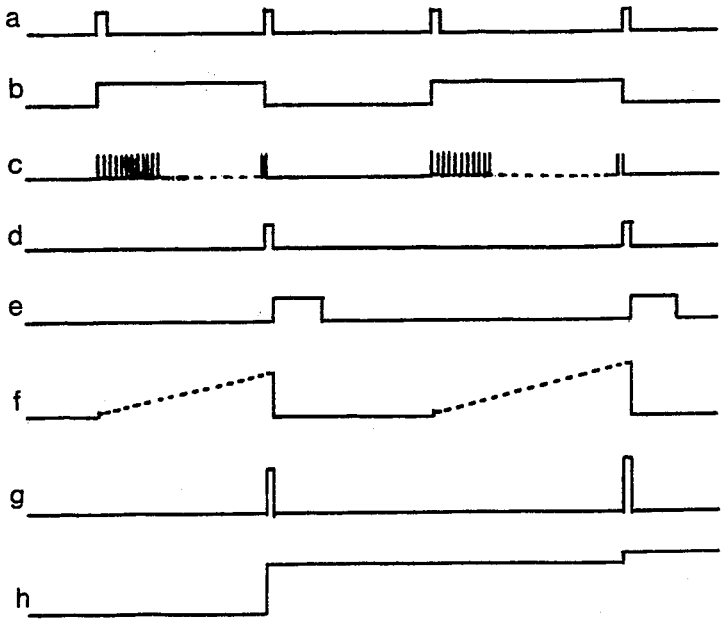
FIG. 9 is a schematic pulse diagram serving for explaining the mode of operation of the switching circuit depicted in FIG. 8.
Figure 8:
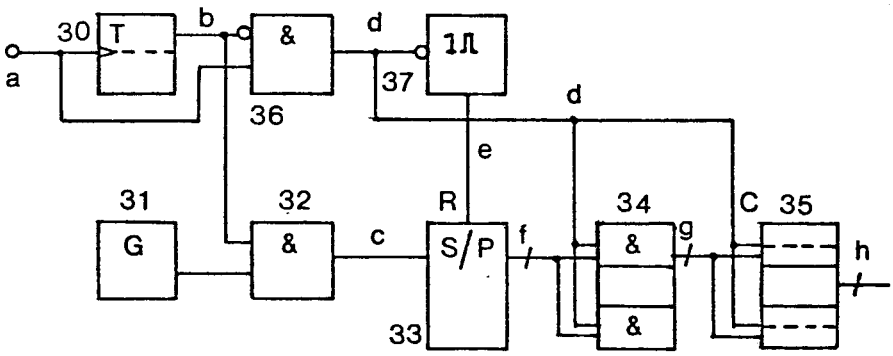
FIG. 8 is a detail circuit diagram of one of the switching circuits depicted in the arrangement of FIG. 7.

FIGS. 8 and 9 explain the construction and the mode of operation of the time measuring circuits 26 and 27. Since these time measuring circuits 26 and 27 are of identical construction the following description is valid for both such circuits. FIG. 9 schematically illustrates a number of rows of signals a to h which are generated in the time measuring circuits.

The function of the time measuring circuit illustrated in FIG. 8 resides in converting the distances or spacing of the pulses a, FIG. 9, delivered by the related sensors 2 and 6, respectively, into serial digital form and to store such in parallel form in a digital storage 35. This is accomplished in the intervals governed by the rotation of the grooved drum N and the cross-wound package K, respectively, and there is continuously available the last measured value of the time or duration $t_n$ and $t_k$, respectively, at the output of the digital storage 35.

The values of $t_n$ and $t_k$ are not constant during the winding operation; in particular, during the start-up and shutdown of the winding location or station they tend to ascend and drop relatively rapidly.

The sensor pulses a, FIG. 9, delivered by the sensors 2 and 6, respectively, are transformed in a binary divider or T-toggle element 30 into a sequence of rectangular or squarewave time measuring pulses b of the length $t_k$ and $t_n$, respectively. A clock generator 31 generates clock pulses of a frequency of, for instance, 100 kHz or greater. The clock pulses and the time measuring pulses b are inputted to an AND-gate 32 which delivers with the clock frequency synchronous serial time measuring pulses c. Such are inputted to and stored in a serial-to-parallel coder 33, briefly S/P-coder, provided with a reset input R, until the S/P-coder 33 is reset by a reset pulse e. There may be utilized as the S/P-coder 32 a shift register.

At the for instance m=16 outputs of the S/P-coder 33 there appears after each uneven sensor pulse a the digital value of one of each counted time measuring pulse c in parallel form, as the same has been indicated by the step or ramp-shaped pulse f.

In order to generate the reset pulse e there are provided an AND-gate 36 with a negated input and a monostable toggle element 37, also briefly referred to as a monoflop, connected at the output of the AND-gate 36. The negated input of the AND-gate 36 is connected with the output of the T-toggle element 30, the other input with the input of the T-toggle element 30. The AND-gate 36 delivers during each second sensor pulse a a control pulse d, the trailing edge of which actuates the monoflop 37, so that such furnishes a reset pulse e.

The m-parallel output lines of the S/P-coder 33 are connected in each case with an input of one of m-AND-gates 34. The second inputs of such AND-gates 34 have inputted thereto the already mentioned control pulse d. With each control pulse d there appears at the outputs of the m-AND-gates 34 the digital value which prevails at the end of the ramp or step-shaped signal f, as such has been indicated by reference character g. This value is representative of the magnitude $t_g$ and $t_n$ in parallel digital form.

The m-outputs of the AND-gates 34 are connected with the m-data inputs of the data storage 35 which can consist of m-parallel D-toggle elements. The second inputs or control inputs C of the D-toggle elements are controlled by the already mentioned control pulses d. Accordingly, during each control pulse d there is stored the digital value of the signal g in the digital storage 35 and such remains stored until the arrival of the next control pulse, as such has been indicated by the step-shaped curve h. At the m-outputs of the digital storage 35 there thus continuously appears the value of the times or durations $t_k$ and $t_n$, respectively, in parallel digital form.

The evaluation circuits described in conjunction with FIGS. 5 and 7 can be designed both as analog and also as digital measuring circuits. With the predominantly employed digital evaluation there must be provided appropriate clock or cycle pulse transmitters which deliver the high-frequency clock pulses required for measuring the individual parameters, especially the diameter D and the rotational speeds k and n and $t_k$ and $t_n$, respectively, as such has been described in conjunction with FIG. 8.

The indicated equations (4) or (11) also can be replaced by approximation equations which are obtained from expansion of a function in a series. In this case the exact equations (4) and (11) provide the possibility of estimating the errors caused by the approximation.

The slip S also can be expressed in a different manner, for instance by the equation:

$$s=S-1$$

if the slip is defined by the magnitude s, then the value s=0 means no slip, the value s>0 means that slip is present.

The described embodiments are concerned with the case of a cylindrical cross-wound package. However, they also can be valid for a conical cross-wound package provided that the cone angle does not exceed the usual small values. There is then used in place of the diameter D of the cylindrical cross-wound package the mean diameter of the conical package.

The continuous measurement of the angular position of the pivotal arm A and the diameter D, respectively, of the cross-wound package K is not subject matter of the present invention. It can be accomplished by known techniques, for instance in accordance with the known method disclosed for instance in the aforementioned U.S. Pat. No. 4,024,645.

While there are shown and described present preferred embodiments of the invention, it is to be distinctly understood that the invention is not limited thereto, but may be otherwise variously embodied and practiced within the scope of the following claims. Accordingly,

What we claim is:

1. A method for determining the length of a yarn wound upon a cross-wound package at a winding apparatus with the aid of a friction drive by means of a grooved drum, comprising the steps of:

continuously measuring during the winding operation in successive time intervals the slip governed by the ratio of the circumferential velocities of the grooved drum and the cross-wound package;

determining therefrom a measured magnitude of the slip; and undertaking with aid of the measured magnitude of the slip a correction of the yarn length determined during the momentary successive intervals without taking into account the slip.

2. The method as defined in claim 1, further including the steps of:

determining the slip in accordance with the equation $$S=n.d/k.D$$

wherein, n and k represent the number of revolutions during one predetermined interval, and d and D represent the diameter of the grooved drum and the cross-wound package, respectively.

3. The method as defined in claim 2, further including the steps of:

defining the length of the individual intervals by counting a predetermined number of revolutions of the grooved drum or the cross-wound package.

4. The method as defined in claim 3, wherein:

said predetermined number of revolutions of the grooved drum or the cross-wound package amounts to approximately 1,000.

5. The method as defined in claim 1, further including the steps of:

defining the length of the individual intervals by counting a predetermined number of revolutions of the grooved drum or the cross-wound package.

6. The method as defined in claim 5, wherein:

said predetermined number of revolutions of the grooved drum or the cross-wound package amounts to approximately 1,000.

7. The method as defined in claim 1, further including the steps of:

determining the slip according to the equation:

$$S=t_k.d/t_n.D$$

wherein, $t_k$ and $t_n$ respectively designate the duration of one revolution of the cross-wound package and the grooved drum, and D and d respectively designate the diameters thereof.

8. The method as defined in claim 2, further including the steps of:

accomplishing the determination of the yarn length based upon the following equation for the length of an individual yarn winding applied to the cross-wound package:

$$U = \pi D \sqrt{1 + S^2 tg^2 \alpha}$$

wherein $\alpha$ represents the constant groove angle of the grooved drum.

9. The method as defined in claim 7, further including the steps of:

accomplishing the determination of the yarn length based upon the following equation for the length of an individual yarn winding applied to the cross-wound package:

$$U = \pi D \sqrt{1 + S^2 tg^2 \alpha}$$

wherein $\alpha$ represents the constant groove angle of the grooved drum.

10. The method as defined in claim 2, further including the step of:

accomplishing the determination of the yarn length based upon the following equation for yarn lengths applied during one revolution of the grooved drum to the cross-wound package:

$$Z = \pi d \sqrt{1/S^2 + tg^2 \alpha}$$

wherein $\alpha$ represents the constant groove angle of the grooved drum.

11. The method as defined in claim 7, further including the step of:

accomplishing the determination of the yarn length based upon the following equation for thread lengths applied during one revolution of the grooved drum to the cross-wound package:

$$Z = \pi d \sqrt{1/S^2 + tg^2 \alpha}$$

wherein $\alpha$ represents the constant groove angle of the grooved drum.

* * * * *